United States Patent [19]

Cloup

[11] Patent Number: 4,719,781

[45] Date of Patent: Jan. 19, 1988

[54] DEVICE FOR STRAIGHTENING METAL WIRES BY MEANS OF A PLURALITY OF ROLLERS

[76] Inventor: Jean Cloup, Château Beaugey-Carignan, 33360 Latresne, France

[21] Appl. No.: 894,019

[22] Filed: Aug. 7, 1986

[51] Int. Cl.[4] ..... B21D 3/02; B21F 1/02

[52] U.S. Cl. ..... 72/164; 72/162

[58] Field of Search ..... 72/164, 165, 160–162; 140/147

[56] References Cited

U.S. PATENT DOCUMENTS

| | | | |
|---|---|---|---|
| Re. 10,276 | 1/1883 | Seaman | 72/164 |
| 2,092,840 | 9/1937 | Greene | 72/162 |
| 2,323,768 | 7/1943 | Hanna | 72/165 |
| 2,517,309 | 8/1950 | Heller . | |
| 2,720,242 | 10/1955 | Siegerist | 72/164 |
| 4,399,677 | 8/1983 | Price, III et al. | 72/164 |

FOREIGN PATENT DOCUMENTS

| | | | |
|---|---|---|---|
| 164646 | 11/1905 | Fed. Rep. of Germany | 72/164 |
| 699500 | 11/1940 | Fed. Rep. of Germany | 72/165 |
| 467554 | 6/1914 | France . | |
| 1030526 | 1/1951 | France . | |
| 2550973 | 3/1985 | France | 72/164 |
| 730425 | 5/1980 | U.S.S.R. | 140/147 |

*Primary Examiner*—Daniel C. Crane

*Attorney, Agent, or Firm*—Lowe, Price, LeBlanc, Becker & Shur

[57] ABSTRACT

This invention relates to a device for straightening metal wires by means of a plurality of straightening rollers located alternately on either side of the wire, comprising a fixed chassis, a fixed carriage and mobile carriages guided on two bars parallel to the general direction of the wire. Two adjacent carriages are connected by levers assembled as scissors articulated on the carriages in the lower part and on sliding blocks guided vertically on the carriages in the upper part. A plurality of carriages and lever systems are assembled so that the distance between two adjacent carriages remains identical whatever the carriages in question during displacement of one of them. Each carriage bears one of the rollers located above the wire. Each roller located beneath the wire is borne by one of the levers, and located in an intermediate position between two adjacent upper rollers so that it moves away from said rollers and moves downwardly when the carriages are moved apart.

10 Claims, 4 Drawing Figures

11b
114b
111b
116b
113b
112b
31b
33b
51b
43a
115b
11a
111a
114a
116a
113a
112a
31a
505a
33a
71a
41a
61a
115a
51a
11
111
114
116
112
113
505
31
33
71
43
41
61
51
101
504
30
32
70
42
40
60
115
10
102
104
106
103
50
105
20
21
22
1
II
III

DEVICE FOR STRAIGHTENING METAL WIRES BY MEANS OF A PLURALITY OF ROLLERS

The present invention relates to a device for straightening metal wires by means of a plurality of straightening rollers located in the same plane alternately on either side of the path of the wire contained in said plane and acting alternately to bend said wire in one direction then in the opposite direction during its passage between the rollers, this device being of the type comprising a fixed frame, an odd number, at least equal to five, of straightening rollers distributed in two series disposed on either side of the path of the wire, the first series comprising at least three so-called reference straightening rollers whose axes lie in the same fixed plane with respect to the frame and parallel to the general direction of the wire, the second series comprising one roller less than the first series, the rollers of this second series also having their axes located in the same plane parallel or slightly inclined with respect to the plane of the axes of the reference rollers, and being located on the wire side opposite said reference rollers, each of the rollers of the second series being disposed in an intermediate position between two reference rollers, the device also comprising carriages each bearing a reference roller via a pin, one of the carriages being fixed with respect to the frame and the other carriage being mobile and guided parallel to the general direction of the wire, and mobile supports each bearing, via a pin, a roller of the second series, these supports being guided with respect to the fixed frame so that the displacement of the carriages bring about a simultaneous displacement of the supports by means of a lever system so that the relative movement, respectively, of the reference rollers causes a substantially proportional relative movement, respectively, of the planes containing, on the one hand, the axes of the reference rollers and, on the other hand, the axes of the rollers of the second series.

This type of straightening device is known for example by French Pat. No. 84 09509 (Publication No. 2,565,856).

In the device described in this document, the rollers are five in number. The fixed carriage is surrounded by the two mobile carriages which may move away from or towards the fixed carriage symmetrically. In their movement, the mobile carriages each drive one end of a lever articulated on the frame towards the second series of rollers thanks to a pin sliding in a groove in said lever. A small rod is articulated on said lever and drives the mobile support of a roller of the second series, this support being guided by a slide-way inclined with respect to the direction of the wire so that, when the mobile carriage moves away from the fixed carriage, the roller of the second series borne by the mobile support also moves away both from the reference rollers and from the theoretical axis of the wire, whilst remaining in a substantially median position between two of said reference rollers. In this way, when the two mobile carriages are controlled to move away symmetrically from the fixed carriage, the spacing apart of all the rollers increases both in the general direction of the wire and in the direction perpendicular thereto. When the diameter of the wire increases, the rollers may thus be moved apart by a single control, conserving within the desired limits the ratio of the spacing between the two series of rollers and the distance "A" between the axes of two rollers taken in the direction of the wire, the maintaining of this constant ratio being necessary when it is desired to straighten wires of different diameters, the spacing of the two series of rollers depending directly on the diameter "d" of the straightened wire.

However, this device is limited in its use by the number of rollers which cannot be greater than five.

Russian document No. SU-A-730 425 describes another system of straightening by rollers which may comprise a larger number of rollers, such rollers being disposed at the ends of levers which connect the pins of the rollers placed alternately on either side of the path of the wire, these levers thus forming a saw-tooth assembly. In that case, by a traction at the end of the lever assembly, the rollers of one series are moved apart from one another, but by the play of the levers which tend to be aligned, the distance between the two series of rollers in the direction perpendicular to that of the wire is reduced. Of course, in that case, the ratio between the diameter "d" of the wire and the distance "A" between two adjacent rollers cannot be maintained within acceptable limits.

It is an object of the present invention to propose a device for straightening by rollers, in which the number of rollers may be greater than five, while maintaining a suitable ratio d/A.

It is another object of the invention to propose a straigtening device which may easily be adapted by a simple adjusting means to different wire diameters, whatever the number of rollers.

These objects are attained, according to the invention, by a device for straightening by rollers, characterized in that each of the carriages bearing the reference rollers extends downwardly beyond the path of the wire over a sufficient length and bears at its lower end, on the wire side opposite the one where the roller that it supports is located, a pivot pin for the end of a first lever, and comprises on the side of the first series of reference rollers, a groove perpendicular to the general direction of the wire substantially aligned with the pivot pin located at the lower end of the carriage, and extending towards this pin, the pin of the reference roller borne by the carriage being located aside the groove, and in that two adjacent carriages are connected by an assembly of two levers articulated on each other in their median part by a pivot pin to form a scissor type assembly, the assembly of two levers comprising said first lever of which one end is articulated on the lower pivot pin of a first carriage, its other end pivoting on a journal borne by a slide block mobile in the groove in the adjacent carriage located towards the first carriage nearest the pin of its reference roller, and a second lever which is itself articulated by one end on the lower pivot pin of said adjacent carriage and by the other end on the pin of a slide block mobile in the groove of the first carriage, and in that the second lever or support lever bears, in the zone located between its articulation on the lower end of said adjacent carriage and the pivot pin of the two levers, a roller of the second series.

Of course, the definition of the invention which has just been given considers that the device is observed when the direction of the wire is horizontal and the plane containing the rollers is vertical, the reference rollers being located above the path of the wire. The device may of course be used in any other position.

One advantage of the device according to the invention resides in the fact that all the carriages may be identical, including the fixed carriage, in the same way as the lever systems which connect them.

Another advantage is that as many carriages and lever systems as desired may be disposed one after the other to form a wire straightening device comprising a large number of rollers.

A further advantage is that, whatever the number of carriages, therefore of rollers, the relative displacement of two adjacent carriages brings about an identical relative displacement of any two adjacent carriages, as well as a variation in the spacing of the two series of rollers substantially proportional to said displacement. In particular, it suffices to displace any mobile carriage with respect to the fixed carriage for the variations of the distance between two adjacent carriages to be identical for the whole of the device, the variation in the spacing between the two series of rollers itself being substantially proportional to the provoked displacement of said mobile carriage.

With the device according to the invention, the relative spacings of the rollers may rapidly and easily be varied by one single control in order to adapt their position to the conditions of use of the device and in particular to the diameter or section of the straightened wire.

According to a particular arrangement of the invention, the rollers are mounted on the mobile supports or on the carriages, respectively, by means of an adjustable cam system.

The position of the rollers on their supports may thus be adjusted independently with precision, for example to place the axes of the rollers of the same series perfectly in the same plane, in particular an oblique plane with respect to the plane of the axes of the reference rollers, such adjustment not needing to be modified subsequently when changing the diameter of the wire.

The invention will be more readily understood on reading the following description with reference to the accompanying drawings, in which.

Figure 1:
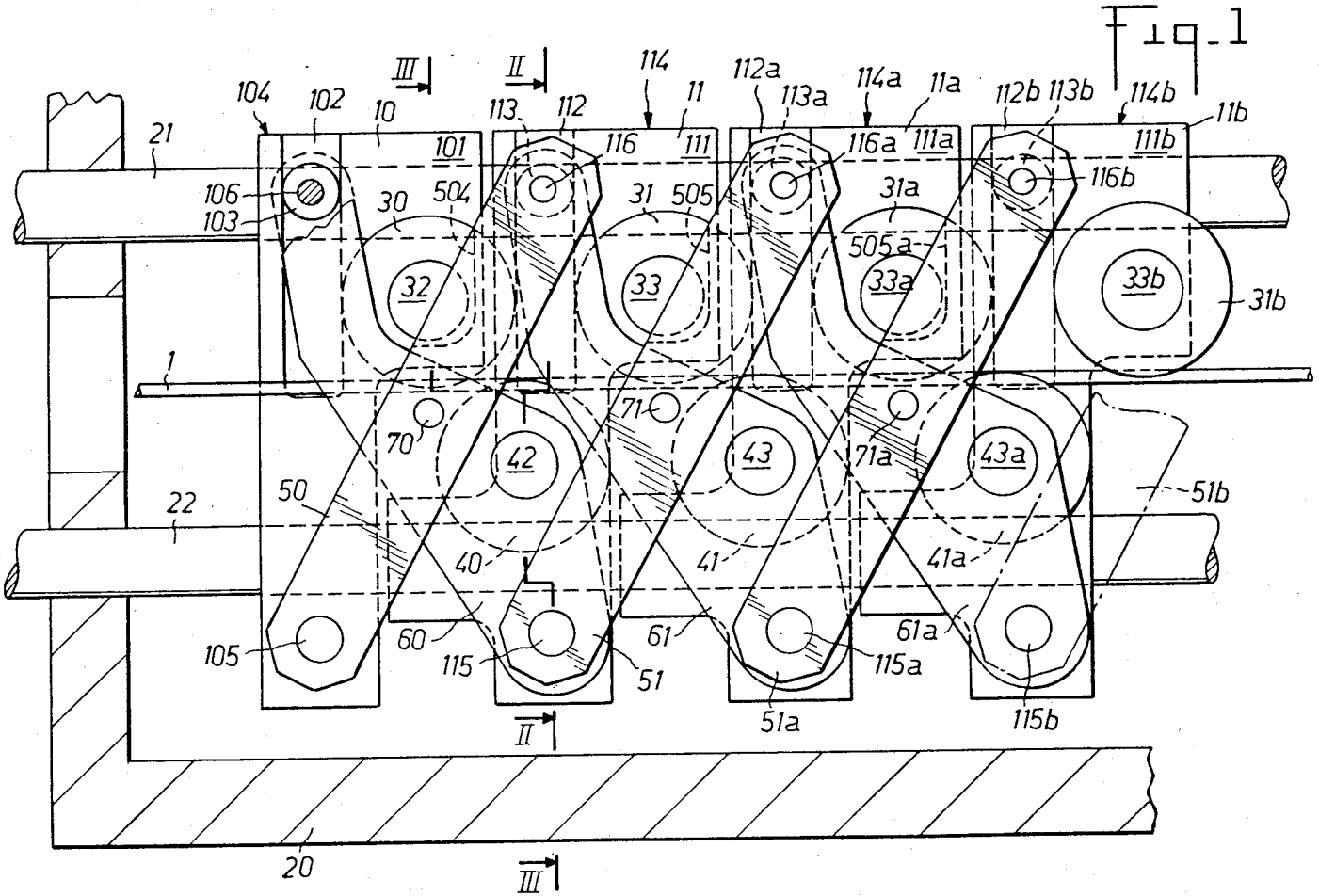
FIG. 1 is an overall view of a device according to the invention comprising seven rollers.

Referring now to the drawings, the device shown in FIG. 1 comprises a fixed frame 20 which supports two bars 21, 22 of circular section disposed one above the other and which serve as a guide for carriages 10, 11. Carriage 10 is maintained fixed with respect to frame 20 by connection means (not shown). The other three carriages **11, 11*a*, 11*b* are mobile in the general direction of the wire 1 to be straightened. Carriage 10 bears via a pin 32 a roller 30 which forms part of the series of reference rollers 30, 31, 31*a*, 31*b* whose axes lie in the same horizontal plane parallel to the general direction of wire 1. Mobile carriages 11 bear, via pins 33, 33*a*, 33*b*, the other rollers 31, 31*a*, 31*b*. All these rollers 30 to 31*b* lie in the same plane perpendicular to the plane which comprises their axes. The periphery of the rollers is hollowed in a circular groove, for example of triangular section or the like, which guides wire 1** during its passage in the device.

Carriages **10, 11, 11*a*, 11*b* comprise on their front faces 101, 111, 111*a*, 111*b*, guide grooves 102, 112, 112*a*, 112*b* in which slide blocks 103, 113, 113*a*, 113*b* may move. These grooves extend downwardly substantially to the height of the passage of wire 1 from the upper face 104, 114, 114*a*, 114*b* of the carriages perpendicularly to the general direction of wire 1, and are offset for each carriage, towards the left according to FIG. 1, from the position of the pin 32, 33, 33*a*, 33*b* of rollers 30, 31, 31*a*, 31*b* corresponding to said carriages. Each carriage 10 to 11*b* also bears in its lower part a lower pivot pin 105, 115, 115*a*, 115*b* disposed parallel to pins 32 to 33*b* of rollers 30 to 31*b*, serving as articulation for the end of a first lever 50, 51, 51*a*, 51*b*. This first lever is articulated at its other end on a pin 116, 116*a*, 116*b* borne by slide block 113, 113*a*, 113*b* of carriage 11, 11*a*, 11*b* located immediately to the right of carriage 10, 11, 11*a* which bears the lower articulation 105, 115, 115*a* of said first lever 50, 51, 51*a***.

A second lever **60, 61, 61*a* supports via a pin 42, 43, 43*a* a roller 40, 41, 41*a* of the second series. This support lever 60, 61, 61*a* has its upper end articulated on the journal 106, 116, 116*a* of the slide block 103, 113, 113*a* of the carriage 10, 11, 11*a* and its lower end articulated on the lower articulation 115, 115*a*, 115*b* of the adjacent carriage 11, 11*a*, 11*b* to the right. The distances between articulations of the first levers 50, 51, 51*a*, 51*b* and of the support levers 60, 61, 61*a*, . . . are equal. The first levers 50, 51, 51*a*, 51*b* and the support levers 60, 61, 61*a*, . . . are articulated together by a pivot pin 70, 71, 71*a* located on each lever at an equal distance from the lower pivot pin 105, 115, 115*a*, 115*b* and the pin of journal 106, 116, 116*a*, 116*b***.

These levers 50 and 60, 51 and 61, or **51*a* and 61*a*, thus form the two legs of scissors which open when two adjacent carriages, for example 10 and 11, are moved apart, the lower pivot pins 105, 115, 115*a*, 115*b* remaining in the same fixed horizontal plane, and journals 106, 116, 116*a*, 116*b* moving downwardly by displacement of slide blocks 103, 113, 113*a*, 113*b* in their respective grooves 102, 112, 112*a*, 112*b*. The second-series rollers 40, 41, 41*a* respectively, connected by pins 42, 43, 43*a* to the support levers 60, 61, 61*a* is thus likewise displaced downwardly by pivoting about the lower pivot pin 115, 115*a*, 115*b***.

Carriage 10 being fixed with respect to frame 20, when adjacent carriage 11 is displaced to the right, the following different movements are produced:

pin 115 moves towards the right parallel to the guide bars 21, 22 and therefore to the general direction of wire 1;

journal 106 borne by slide block 103 of the fixed carriage moves downwardly perpendicularly to the general direction of wire 1;

the pivot pin 70 moves downwardly and towards the right along an arc of circle about the lower pivot pin 105 of the fixed carriage 10;

journal 116 borne by slide block 113 of mobile carriage 11, also moves downwardly in an arc of circle about said pin 105, slide block 113 then moving downwardly in its groove 112;

pin 42 of roller 40 borne by the support lever 60 then follows a path resulting from a downward rotation towards the left about the lower pivot pin 115 of the support lever 60, simultaneously with the horizontal displacement of said pin 115 towards the right.

By so doing, roller 40 moves away both from the reference roller 30 borne by the fixed carriage 10 and from the reference roller 31 borne by the mobile carriage 11.

The position of pin 42 of roller 40 on the support lever 60 is such that the path of this roller 40 has a slight slope with respect to the general direction of the wire, principally during the beginning of the movement of separation of the carriages from their closest position, this slope increasing progressively when the relative moving apart of the carriages increases. This results in a slight downward displacement of the roller 40, for a clearly greater relative horizontal separation between the rollers of the same series, i.e. in a relative spacing apart of the two series of rollers which is relatively small with respect to the relative spacing apart of two rollers of the same series.

This feature is particularly advantageous as it leads to varying the relative position of the rollers when the diameter of the wire to be straightened is changed, while adapting the amplitude of the deformations undergone by the wire during straightening to the diameter thereof.

In order to effect the desired path for rollers **40, 41, 41*a* of the second series in practice, each of pins 42, 43, 43*a* is positioned on the corresponding support lever 60, 61, 61*a* in the zone included between the lower pivot pin 115, 115*a*, 115*b* and the pivot pin 70, 71, 71*a*, and slightly offset towards the left with respect to the vertical passing through said lower pivot pin 115, 115*a*, 115*b*, when carriages 10, 11, 11*a*, 11*b* are brought as close as possible to one another (FIG. 1**).

Furthermore, this position of the lower roller **40, 41, 41*a* close to the lower pivot pin 115, 115*a*, 115*b* is particularly advantageous from the standpoint of mechanical strength of the assembly of levers and articulations. In fact, during the straightening operation, considerable efforts are exerted on the rollers. It is desirable if the effort transmitted to the support lever 60, 61, 61*a* by the lower roller 40, 41, 41*a*, is distributed preponderantly on the lower pivot pin 115, 115*a*, 115*b* which is rigidly connected to the carriage and may be of considerable section, rather than on pivot 70, 71, 71*a* and journal 106, 116 or 116*a* which, via the corresponding first levers 50, 51 or 51*a*, abut on the lower end of the adjacent carriages on the left (in FIG. 1). This arrangement also avoids applying considerable force on the corresponding slide blocks 103, 113 or 113*a***.

Of course, the foregoing description of the functional elements of the device may be transposed to other unitary elements of the device comprising a carriage, a system of levers and associated rollers, whatever the number of these unitary elements.

It will be readily understood that the relative movements of the different mobile members follow from the above description, considering the first two carriages.

However, it is specified that, if a first mobile carriage adjacent the fixed carriage moves by a distance "D" with respect to said fixed carriage, a second mobile carriage adjacent said first mobile carriage will move by a double distance, viz. "2D", with respect to this fixed carriage. Similarly, the distance will be "3D" for a possible third mobile carriage adjacent the second. This reminder will clarify the description which will be given hereinafter of means for controlling the displacement of the mobile carriages.

Figure 2:
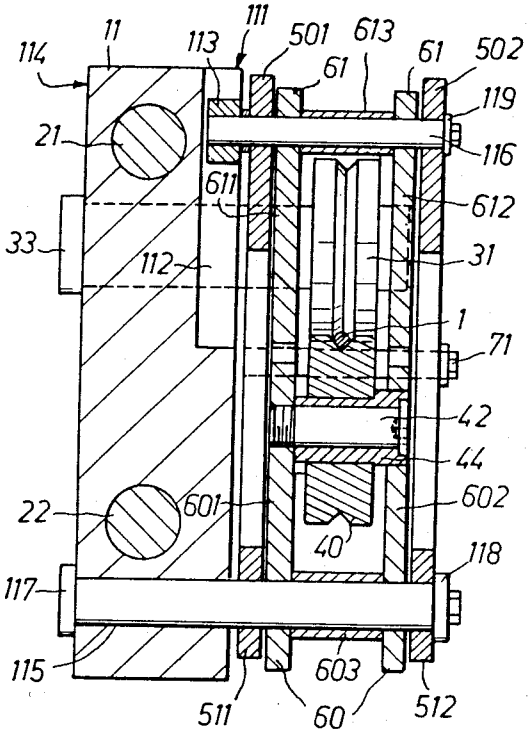
FIG. 2 is a view in section along broken line II—II of FIG. 1 and showing the relative arrangement of the different elements of the device.

Beforehand, the constructive arrangements relative to the lever systems and to their articulations, as well as to the devices for adjusting the position of the rollers on their supports by cam, will be specified. Reference will firstly be made to FIG. 2 which shows the relative arrangement of the levers, pins and rollers in a transverse section through the device.

It is specified that, in order to respect the rules of the drawing, the view of FIG. 2, in section along line II—II of FIG. 1, shows for the levers elements which are similar but belong to two different lever systems, depending on whether they are located in the upper part or in the lower part of the Figure. In order to avoid ambiguity, reference will be made in the following description equally well to the references of one or the other of the lever systems. The latter being similar, and the references being corresponding, the following description should be readily understood by the man skilled in the art.

The support lever 60, 61 or **61*a* is in fact constituted by two plates 601 and 602 or 611 and 612 connected together at the level of the lower pivot pin 115 or 115*a* and of journal 106 or 116, by bored spacer elements or bushes 603 or 613 traversed by said pivot pins. The two plates 601 and 602 or 611 and 612 surround a roller of the second series 40, 41 or 41*a*, pin 42, 43 or 43*a*** of this roller passing through the said two plates and being screwed on at least one of them.

The first lever 50, 51 or **51*a* is also composed of two plates 501 and 502 or 511 and 512 placed outside the plates of the support levers 60, 61, 61*a* and also articulated on the lower pins 105, 115, 115*a* or 115*b* and the journals 116, 116*a* or 116*b* borne by the slide blocks 113, 113*a* or 113*b***.

The pivot pin 70, 71 or **71*a* passes through the four plates constituting the two levers 50 and 60, 51 and 61 or 51*a* and 61*b* of the same lever assembly and is fixed on one of the plates of the first lever 50, 51 or 51*a***, by a screwed stop plate.

Each lower pivot pin such as 115 passes through the corresponding carriage such as 11 and the second and first levers such as 60 and 51 which are articulated thereon and it is maintained on one side by a head 117 and on the other side by a washer 118 screwed at its end.

Fach journal such as 116, with the exception of those associated with the end carriages such as 10 and **11*b*, passes through the levers such as 50, 61, is fixed on one of the plates 502 of the first lever by a screwed stop plate 119 and engages at its end in a bore in the corresponding cylindrical slide block such as 113**.

As shown in FIG. 1, plate 501 or 511 constituting the first lever 50, 51 or **51*a* and closest to the carriages comprises a cut-out 504, 505 or 505*a* allowing passage of pin 32, 33 or 33*a* of the reference roller 30, 31 or 31*a*** when the carriages are brought closer to one another.

Figure 3:
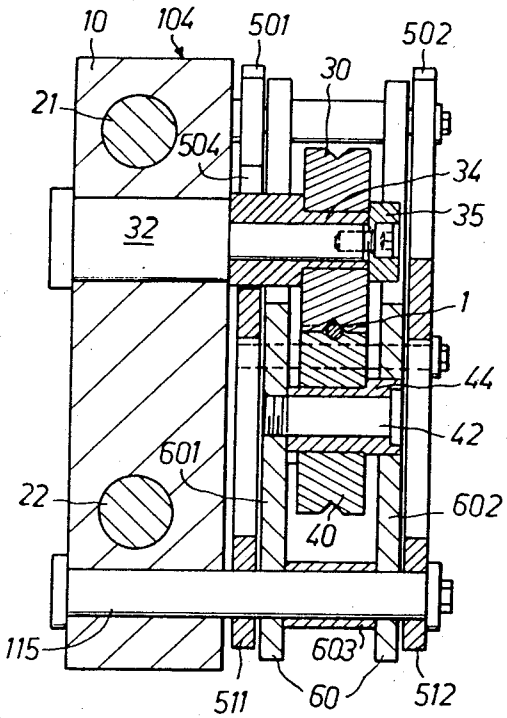
FIG. 3 is a view in detail in section along III—III showing the cam system for adjusting the position of the rollers.

FIG. 3 shows the cam systems allowing precise adjustment of the rollers in position.

Each pin such as 32 bearing a reference roller such as 30 passes through the carriage such as 10 and bears on its projecting part on the roller side a cam 34 serving as bearing for roller 30. Cam 34 is maintained in position by tightening, after adjustment, by means of a support washer 35 fixed by screwing at the end of pin 32.

Each pin such as 42 bearing a roller such as 40 of the second series is screwed in the plate 601 constituting the support lever such as 60. It bears a cam 44 which serves as bearing for roller 40 and which is maintained in position by tightening, after adjustment, of said pin 42.

A device for controlling the displacement of carriages **10, 11, 11*a* will now be described with reference to FIG. 4**.

As has been specified in the description of the operation of the straightening device, it suffices, in order to obtain displacement of all the carriages, to control the moving apart or approach of any two of these carriages, and in particular, of a mobile carriage with respect to the fixed carriage. It was considered hereinabove that this fixed carriage was carriage 10 located to the extreme left (according to FIG. 1). It will be readily understood that this is not imperative and that any one of the carriages may be fixed, whether or not it is located at an end of the assembly of carriages. In fact, thanks to the system of levers articulated in scissor form, the mobile carriages will always be displaced so as to maintain constant the distance between two adjacent carriages, whatever the carriages in question.

Figure 4:
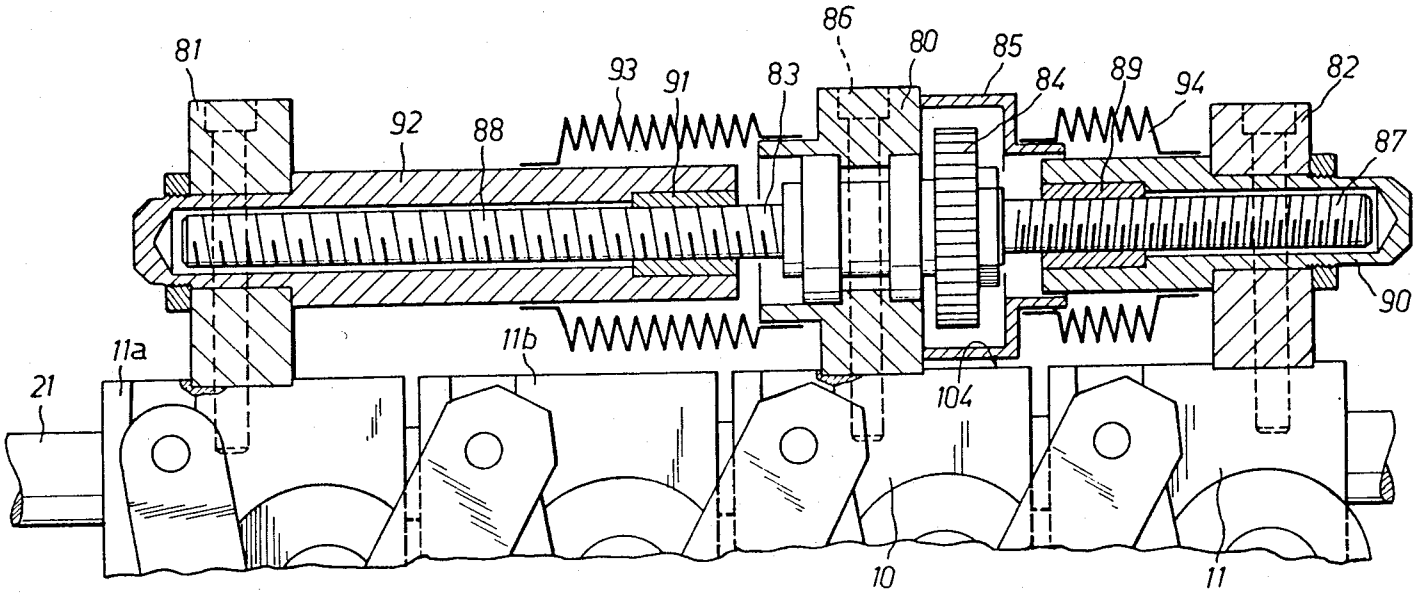
FIG. 4 is a view in longitudinal section of a device for controlling the spaced apart relationship of the carriages.

In the system shown in FIG. 4, comprising four carriages and therefore seven rollers, the fixed carriage 10 is the third from the left, a mobile carriage 11 being located to its right, and two mobile carriages 11*a* and 11*b* being located to its left.

Although, as has already been specified, it suffices to control the movement of one single mobile carriage with respect to the fixed carriage in order to obtain displacement of all the other mobile carriages, it may be preferable to control the displacement of two mobile carriages simultaneously, this facilitating the displacements of the assembly of mobile carriages by reducing the stresses on the lever systems and their articulations.

In the embodiment of the invention shown in FIG. 4, there are provided two end mobile carriages 11 and 11*a* controlled so as to move in opposite direction with respect to the fixed carriage 10, the left-hand carriage 11*a* effecting a displacement double that of the right-hand carriage 11, since another mobile carriage 11*b* is interposed between said left-hand mobile carriage 11*a* and the fixed carriage 10, whilst the right-hand carriage 11 is directly adjacent said fixed carriage 10.

The fixed carriage 10 bears on its upper face 104 a bearing 80 for a drive screw 83. This screw is driven in rotation by a pinion 84 driven by a chain or gear system (not shown) located inside a protective casing 85. All these parts are therefore fixed in translation since bearing 80 is maintained on the fixed carriage 10 by means of fixing screws 86.

The drive screw 83 bears at its right-hand end a thread 87 of pitch "p" over a length "L" corresponding at least to the maximum relative displacement that the mobile carriage 11 may make. At its other left-hand end, the drive screw 83 bears another thread 88 of double pitch, viz. "2p", of direction opposite the right-hand thread 87, and of length corresponding to the displacement of carriage 11*a*, viz. "2L".

The right-hand thread 87 is in mesh with the corresponding inner thread 89 of a tube 90 fixed on the upper face 114 of the right-hand mobile carriage 11 via a support 82.

Similarly, the left-hand thread 88 is in mesh with the inner thread 91 of a tube 92 fixed on the left-hand mobile carriage 11*a*, via a support 81.

In order to preserve tightness of the system, tubes 90 and 92 are closed at their ends opposite the threads 89, 91 and protective bellows 93, 94 connect them to the fixed bearing 80.

It goes without saying that other systems for controlling the displacement of the mobile carriages may suit, insofar as the relative displacements of the carriages are respected in direction and in amplitude. For example, in the system described hereinabove, only one of the two threads may be maintained, without this having an effect on the kinematics of the displacement of all the mobile carriages.

The invention is not limited to the embodiments described hereinabove by way of example. It has already been stated that the number of rollers may be any odd number greater than or equal to five and therefore that the number of carriages may be greater than three.

The carriages may be guided by means other than the two bars described hereinabove. In particular, such guiding may be effected by one single bar of non-circular section or by a system of slideways for example in dove-tail form.

Similarly, the system for controlling the displacement of the mobile carriages may be connected to the carriages on faces other than their upper face, in particular on the face located on the side opposite the rollers.

The embodiment described is a hyperstatic system and results may be obtained which are certainly similar, less good, but acceptable in certain cases by rendering the system simply static. To that end, it suffices either to eliminate slide blocks 103, 113, 113*a*, 113*b* and the corresponding guide grooves 102, 112, 112*a*, 112*b*, whilst leaving the connection between the first lever 50, 51 or 51*a* and the corresponding second lever 61, 61*a* or 61*b* at the location of the journal 116, 116*a* or 116*b*, or to eliminate the guide bars 21, 22 of the mobile carriages 114, 114*a*, 114*b* which are also guided by the set of levers 50, 51, 51*a*, 60, 61, 61*a*, etc . . .

When the slide blocks such as 103, 113, 113*a*, 113*b* , . . . and the corresponding guide grooves such as 102, 112, 112*a*, 112*b*, . . . are eliminated, the mechanical connection between the successive carriages of the type described hereinabove of a group of at least three carriages such as 10, 11, 11*a* or 11, 11*a*, 11*b*, is as follows:

Two adjacent carriages such as 10 and 11 or 11 and 11*a* or 11*a* and 11*b*, etc . . . are connected by an assembly of two levers 50 and 60 or 51 and 61 or 51*a* and 61*a* articulated on one another in the median part of the first lever 50, 51 or 51*a* with the aid of a pivot pin 70, 71 or 71*a* parallel to the lower pivot pin 105, 115, 115*a* or 115*b* of each carriage of the group, to form a scissor assembly. In this assembly of two levers, the first lever 50, 51 or 51*a* is articulated, by its lower end, on the lower pivot pin for example 105, 115 or 115*a* of a first carriage, for example 10, 11 or 11*b* and the lower end of the second lever 60, 61 or 61*a* is articulated on the pivot pin 115, 115*a* or 115*b* of the second carriage 11, 11*a* or 11*b* towards which the upper end of the first lever 50, 51 or 51*a* leans and which is adjacent said first carriage 10, 11 or 11*a*.

If the first lever 50, 51 or 51*a* leans from its lower articulation 105, 115 or 115*a* on the first carriage 10, 11 or 11*a* in the direction of the adjacent second carriage 11, 11*a* or 11*b*, the second lever 60, 61 or 61*a* leans, from its lower articulation 115, 115*a* or 115*b* in the direction of the first carriage 10, 11 or 11*a*.

It should be noted that, except for the first and last of a train of successive carriages, the lower pivot pin 115 or 115*a* of each carriage 11 or 11*a* bears both a first lever 51 or 51*a* and a second lever 60 or 61, whilst the lower pivot pin 105 of the first carriage 10 of said train of carriages bears only a first lever 50 and the lower pivot pin (for example 115*b*) of the last carriage (for example 11*b*) of said train bears only a second lever (for example 61*a*).

The upper end of the first lever 50 or 51 articulated on the first carriage 10 or 11 of a considered group of three carriages 10, 11 and 11*a* or 11, 11*a* and 11*b*, is connected to the upper end of the second lever 61 or 61*a* of the third carriage 11*a* or 11*b* of the group with the aid of a pivot journal 116 or 116*a* parallel to the lower pivot pins 105, 115, 115*a*, 115*b* of carriages 10, 11, 11*a* and 11*b* and located in the same plane perpendicular to wire 1 as the lower pivot pin 115 or 115*a* of the second carriage 11 or 11*a*. It should be noted that the upper end of the second lever 60 articulated on the lower pin 115 of the second carriage 11 is not connected to any end carriage and may therefore be eliminated. The same applies to the upper end of the first lever (51*a* in FIG. 1) of the penultimate carriage (11*a* in FIG. 1). It should also be noted that the pivot pin 70, 71 or 71*a* constitutes the centre of a circle passing through the lower pivot pins 105 and 115 or 115 and 115*a* or 115*a* and 115*b* of the pairs of levers 50 and 60 or 51 and 61 or 51*a* and 61*a* and through the pivot journal or journals 116 or 116 and 116*a* or 116*a* and 116*b* of the upper ends of the first lever 50 or 51 of a first carriage 10 or 11, of the second lever 61 or 61*a* of a third carriage 11*a* or 11*b*.

Likewise in that case, each second lever such as 60, 61 or 61*a* serves as support and bears, in the zone located between its articulation 115, 115*a* or 115*b* on the lower end of the second carriage 11, 11*a* or 11*b* adjacent the first carriage 10, 11 or 11*a* and the pivot pin 70, 71 or 71*a* of an assembly of two levers or pair of levers 50 and 60 or 51 and 61 or 51*a* and 61*a*, a roller 40, 41 or 41*a* of the second series of rollers 40, 41, 41*a*, . . .

Finally, modifications of constructive type may be made to the different mechanical connections at the level of the articulations of the levers or the pins of the rollers, without departing from the scope of the invention as defined by the accompanying claims.

What is claimed is:

1. In a device for straightening metal wires by means of a plurality of straightening rollers located in the same plane alternately on either side of the path of the wire contained in said plane and acting alternately to bend said wire in one direction then in the opposite direction during its passage between the rollers, said device comprising a fixed frame, an odd number, at least equal to five, of straightening rollers distributed in first and second series disposed on either side of the path of the wire, the first series comprising at least three reference straightening rollers whose axes lie in substantially the same fixed plane with respect to the frame and generally parallel to the path of the wire, the second series including one roller less than the first series, the rollers of said second series also having their axes located in substantially the same plane being generally parallel or slightly inclined with respect to the plane of the axes of the reference rollers, and being located on a side of said wire opposite said reference rollers, each of the rollers of the second series being disposed in an intermediate position between two reference rollers, said device also including plural carriages each bearing a reference roller via a pin, one of the carriages being fixed with respect to the frame and the other carriages being mobile and guided parallel to the path of the wire, each of the carriages bearing the reference rollers extending downwardly beyond the path of the wire over a sufficient length and carrying a lower pivot pin a lower portion thereof located on the opposite wire side, an upper portion of each carriage on the side of the first series of reference rollers being formed with a groove generally perpendicular to the path of the wire and substantially aligned with the pivot pin located at the lower portion of the associated carriage and extending towards the pin, the pin of the reference roller borne by the carriage being located adjacent the groove, and wherein two adjacent carriages are connected by an assembly of two levers articulated on each other in their median part by a pivot pin to form a scissor type assembly, said assembly of two levers including a first lever having one end articulated on the lower pivot pin of a first of said adjacent carriages and an opposite end pivoting on a journal borne by a slide block movably mounted in the groove in the carriage adjacent the first carriage, and a second lever which is articulated at one end thereof on the lower pivot pin of said carriage adjacent the first carriage and by the other end on the pin of a slide block movably mounted in the groove of the first carriage, and the second lever carries, in a portion thereof located between its articulation on the lower end of said adjacent carriage and the pivot pin of the two levers, a roller of the second series whereby a displacement of the mobile carriages results in a simultaneous displacement of the levers and a substantially proportional resulting displacement of the reference rollers relative to the rollers of the second series.

2. The straightening device of claim 1, wherein the straightening rollers are mounted on adjustable cams.

3. The device of claim 1, wherein each roller of the second series is mounted on its associated second lever in a position such that, when the carriages are brought closest to one another, the axis of said roller is slightly offset, with respect to the perpendicular to the direction of the wire passing through the lower pivot pin, on the pivot pin side.

4. The device of claim 1, wherein the carriages are guided by two generally parallel cylindrical rods mounted to the fixed frame.

5. The device of claim 1, wherein the straightening rollers comprise seven rollers, and include four carriages and three lever assemblies each including two levers articulated in scissor form and of which one lever bears a roller of the second series of rollers.

6. The device of claim 1, wherein the straightening rollers include nine rollers, and include five carriages and four lever assemblies each comprising two levers articulated in scissor form and of which one bears a roller of the second series of rollers.

7. The device of claim 1, wherein the levers are constituted by two plates which extend along side faces of the rollers.

8. The device of claim 1, further including screw system means connected to the carriages for controlling the relative displacement of the carriages.

9. The device of claim 8, wherein the screw system means comprises a screw controlled in rotation, parallel to the direction of displacement of the carriages and connected in translation to the fixed carriage, and cooperating with the thread of at least one support rigidly connected to at least one mobile carriage.

10. A device for straightening metal wires by means of a plurality of straightening rollers located in the same plane alternately on either side of the path of the wire contained in said plane and acting alternately to bend said wire in one direction then in the opposite direction during its passage between the rollers, said device comprising a fixed frame, an odd number, at least equal to five, of straightening rollers distributed in first and second series disposed on either side of the path of the wire, the first series comprising at least three reference straightening rollers whose axes lie in substantially the same fixed plane with respect to the frame and generally parallel to the path of the wire, the second series comprising one roller less than the first series, the rollers of said second series also having their axes located in substantially the same plane being generally parallel or slightly inclined with respect to the plane of the axes of the reference rollers, and being located on a side of said wire opposite said reference rollers, each of the rollers of the second series being disposed in an intermediate position between two reference rollers, said device also comprising plural carriages each bearing a reference roller via a pin, one of the carriages being fixed with respect to the frame and the other carriages being mobile and guided parallel to the path of the wire, each of the carriages bearing the reference rollers extending downwardly beyond the path of the wire over a sufficient length and carrying a lower pivot pin at a lower portion thereof located on the opposite wire side; and wherein in a group of at least three successive carriages, two adjacent carriages are connected by an assembly of first and second levers articulated on each other in a median part of said first lever by a pivot pin to form a scissor-type assembly the assembly of two levers comprising said first lever of which a lower end is articulated on a lower pivot pin of a first carriage, and a second lever of which a lower end is articulated on a lower pivot pin of the carriage adjacent the first carriage, the upper end of the first lever articulated on the first carriage being connected to the upper end of the second lever of the third carriage by means of a journal parallel to the lower pivot pins of the carriages and located in the same plane perpendicular to the path of the wire as the lower pivot pin of the second carriage; and wherein the second lever serves as a support and bears, in the zone located between its articulation on the lower end of said adjacent carriage and the pivot pin of the assembly of two levers, a roller of the second series, whereby a displacement of the mobile carriages results in a simultaneous displacement of the levers and substantially proportional resulting displacement of the reference rollers relative to the rollers of the second series.

* * * * *